United States Patent [19]

Breslow et al.

[11] 4,124,207

[45] Nov. 7, 1978

[54] GAME APPARATUS

[75] Inventors: Jeffrey D. Breslow, Highland Park; John O. Spinello, Glendale Heights; Eugene Jaworski, Park Ridge, all of Ill.

[73] Assignee: Marvin Glass & Associates, Chicago, Ill.

[21] Appl. No.: 827,949

[22] Filed: Aug. 26, 1977

[51] Int. Cl.[2] ..... A63F 9/00

[52] U.S. Cl. ..... 273/1 R; 24/16 PB; 273/144 B

[58] Field of Search ..... 273/1 R, 1 E, 1 U, 144 B, 273/153 R, 156; 24/16 PB, 30.5 P

[56] References Cited

U.S. PATENT DOCUMENTS

| | | | |
|---|---|---|---|
| 1,674,866 | 6/1928 | Klein | 273/144 B X |
| 2,665,914 | 1/1954 | Steig | 273/144 B |
| 2,936,980 | 5/1960 | Rapata | 24/16 PB X |
| 3,480,275 | 11/1969 | Vernstrom et al. | 273/1 R |
| 3,533,622 | 10/1970 | Foley et al. | 273/1 R |
| 3,652,087 | 3/1972 | Carmen | 273/1 R |

FOREIGN PATENT DOCUMENTS

| | | | |
|---|---|---|---|
| 636,800 | 2/1962 | Canada | 273/156 |
| 1,188,388 | 3/1959 | France | 24/16 PB |
| 1,288,128 | 2/1962 | France | 24/16 PB |
| 1,372,916 | 11/1974 | United Kingdom | 24/16 PB |

*Primary Examiner*—Paul E. Shapiro
*Attorney, Agent, or Firm*—Mason, Kolehmainen, Rathburn & Wyss

[57] ABSTRACT

A physical activity game for opposing teams of two or more players comprises a plurality of adjustable, flexible straps adapted to be looped around the arms and/or legs of the players of each team. An elongated flexible element is provided for each team and is adapted to be passed through the looped straps on the players in a selected order. A chance selector comprising an enlarged mixing area and a restricted display area for a plurality of chance elements is provided for randomly determining the order that the flexible element must be passed through the looped straps on the players' wrists and ankles. The straps and chance elements have corresponding indicia such as color coding whereby the order randomly determined by the chance means directs the order of passage of the flexible elements through the particular color coded straps positioned on the players' arms and legs. After a selected order is determined, the game begins, and the first team of players to complete the passage of the flexible element through all of the looped straps in the proper order wins the game.

10 Claims, 4 Drawing Figures

Fig 1
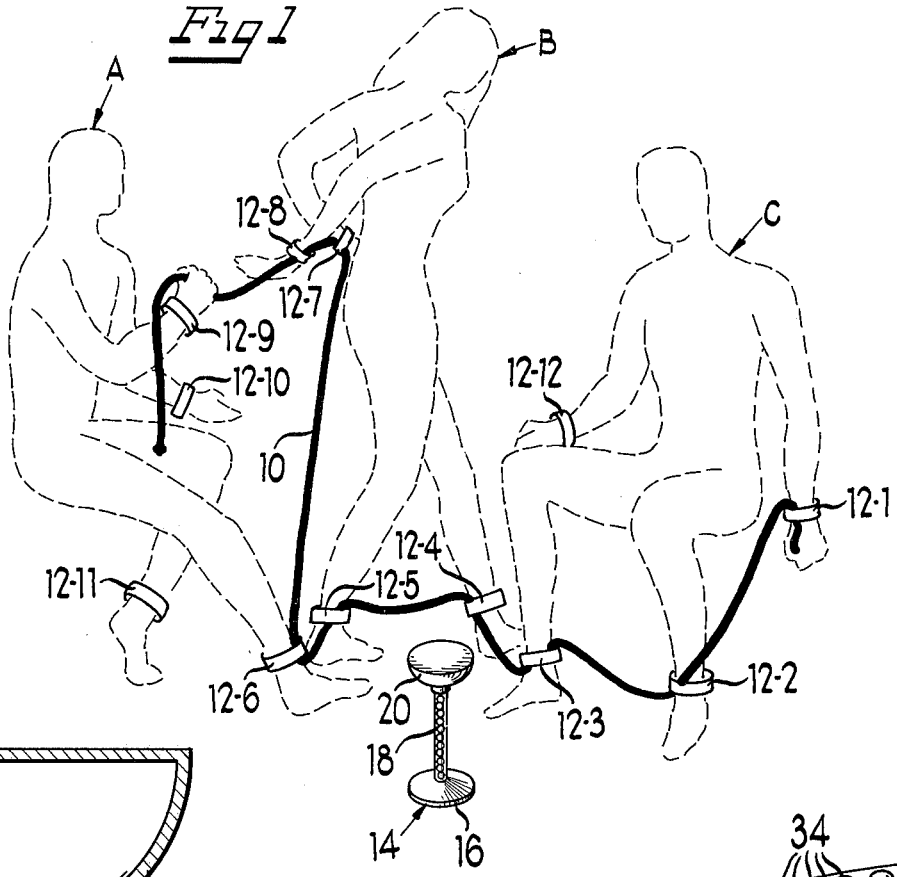
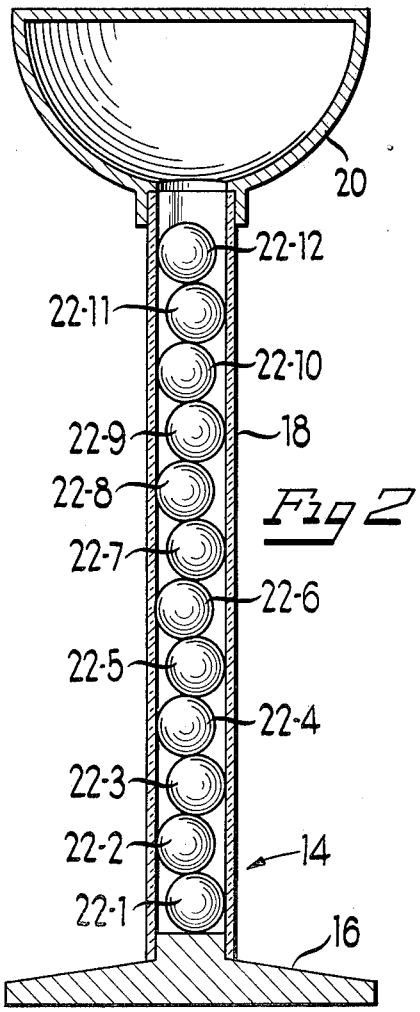
Fig 2
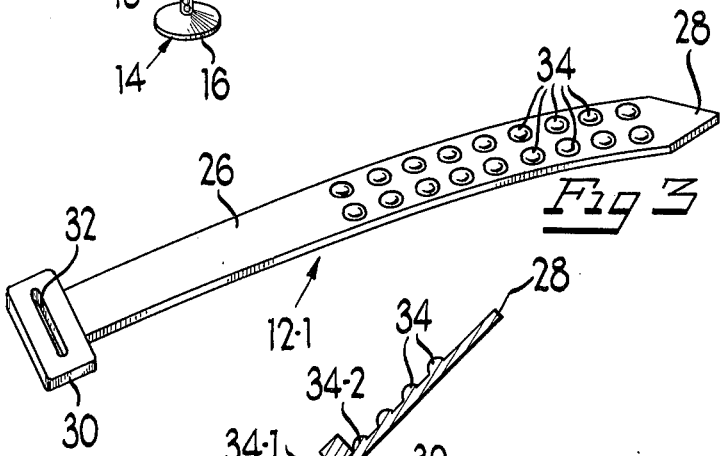
Fig 3
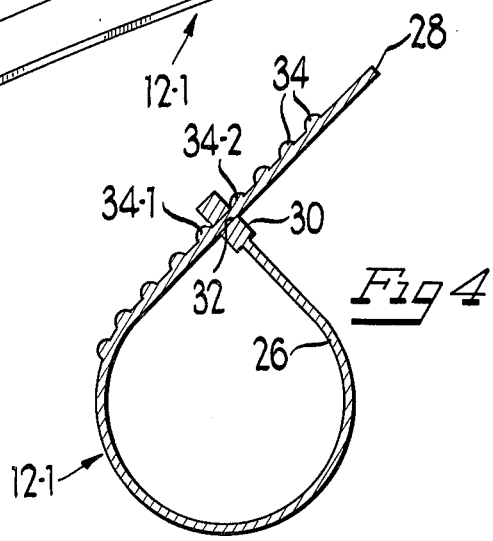
Fig 4

GAME APPARATUS

BACKGROUND OF THE INVENTION

1. Field of the Invention

The present invention relates generally to a game apparatus for opposing teams of two or more players and more particularly to a physical activity game wherein contesting teams of players are pitted against one another in a game involving physical coordination and skill.

2. Description of the Prior Art

U.S. Pat. No. 3,480,275 dated Nov. 25, 1969 is directed toward a game wherein opposing teams of players engage in a physically active contest.

The players encircle themselves with waist, belt or loop forming elements which are interconnected together by a tension cord and on a starting signal, the players of each team attempt to rapidly free themselves from the restrictive loop elements before the players on the opposing team can do so. In U.S. Pat. No. 4,021,035, issued May 3, 1977, a game apparatus is provided wherein an adjustable waist belt is secured on a person and a flexible cord and ball are attached to the belt. Movement of the person's body at the waist causes the ball to rebound back and forth toward and away from the body, thus providing physical exercise.

It is an object of the present invention to provide a new and improved game apparatus for opposing teams of two or more players which requires physical activity, skill and coordination and which is competitive in nature.

Another object of the present invention is to provide a game of the character described which includes a randomly chosen element of chance as a factor in playing the game.

Another object of the present invention is to provide a new and improved game apparatus which is relatively simple and economical, and which promotes physical activity and body contact by the players.

SUMMARY OF THE INVENTION

The foregoing and other objects and advantages of the present invention are accomplished in a new and improved game apparatus for opposing teams of two or more players comprising a plurality of adjustable, flexible straps to be looped around the arms and/or legs of the players on each team. An elongated flexible element is provided for each team and is adapted to be passed through the looped straps positioned on the players in a selected order. The selected order is determined by a chance device and elements thereof are coded to correspond with particular straps so that after an order of passage is determined on a random basis by the chance device, opposing teams of players compete with one another to see which team is the first to complete the passage of the flexible element through all of the looped straps on each players' arms and legs.

In one embodiment of the invention, each player is provided with four straps, two for the wrist or arms and two for the legs or ankles. Each pair of straps is provided with a color code and a chance device in the form of a hollow stemmed, transparent champagne glass with a clear cover on the top is utilized to contain a plurality of balls of different colors corresponding to the straps. The colored balls are randomly mixed around in the upper part of the hollow champagne glass and the glass is then turned right side up to stand on its base and the order in which the colored balls fall into the hollow transparent stem determines the order that the flexible element must be passed through the corresponding color coded looped straps on the arms and legs of the team players. Two or more competing teams of two or more players can enjoy the game and the object is to be the first team to finish passing the flexible cord through all of the looped straps on each player of the team.

BRIEF DESCRIPTION OF THE DRAWINGS

For a better understanding of the present invention, reference should be had to the following detailed description and claims taken in conjunction with the drawings in which:

FIG. 1 is a perspective, animated view of a team of players in action with the game apparatus constructed in accordance with the present invention;

FIG. 2 is a vertical sectional view of a chance device used in the game;

FIG. 3 is a perspective view of one of the adjustable straps used in the game; and FIG. 4 is a transverse sectional view of the strap of FIG. 3 after it has been formed in a loop for positioning on the limb of a player.

DESCRIPTION OF THE PREFERRED EMBODIMENT

Referring now more particularly to the drawings, FIG. 1 illustrates a team of players, A, B and C, in action while playing the game as they are passing an elongated, flexible cord 10 through a plurality of looped straps 12-1, 12-2, etc. which have been previously placed on the wrists and ankles. The order of passage of the flexible cord 10 through the particular straps on the arms and legs of the players is determined in random fashion by a chance device 14 which is placed on the floor nearby for easy viewing by the players of both teams as the game proceeds. The chance device includes a hollow enclosure, preferably formed of clear plastic material shaped to resemble a long stem champagne glass, having a wide base 16 for supporting a hollow stem 18 in an upstanding position on the floor or other surface as shown. At the upper end, there is provided an enlarged enclosure 20 resembling the drinking portion of a champagne glass. The hollow stem 18 is dimensioned with an inside diameter slightly larger than the outer diameter of a plurality of round balls 22-1, 22-2, etc. which are adapted to be contained in a single line or vertical stack when the chance device is placed in an upright position as shown. The glass-like enclosure portion of the device is large enough to contain all of the balls 22-1, 22-2, etc. which are freely movable therein when the champagne glass is turned upside down and shaken. After shaking to mix up the colored balls, the glass-like device is placed in the position shown and the balls fall into the hollow stem 18 in random order. Each of the balls 22-1, 22-2, etc., corresponds to one of the straps 12-1, etc. and the order of the balls in the hollow stem 18 from bottom to top determines the order that the players A, B and C of a team must pass the elongated flexible cord 10 through the corresponding color coded looped straps 12-1, 12-2, etc. which have previously been placed on their arms and legs and looped as shown. Placement of the straps on the players may be random or may be definitely spelled out in the game rules. A convenient means for matching up or associating each of the straps 12-1 etc. with the balls 22-1 etc. is by use of color coding and in an embodiment of the invention as shown with three players on a team, a total of twelve different balls and straps are provided for a team. Each player is provided with two pairs of straps, one pair for his wrists and one pair for his ankles. Each strap may be of a different color for a total of twelve colors or the same color may be used for a pair of straps for a total of only six colors. In either case, the balls 22-1, 22-2, etc. are colored appropriately to correspond.

The rules of the game may be set up so that when pairs of straps of the same color are used, straps of the same color are placed on both ankles or both wrists of one player and pairs of straps of the same color shall not be intermixed between the ankles and wrists. The rules may also provide a wide variety of ways for placement of the straps on the players. For example, the players may simply, on a random basis, apply any color of strap to their arms and legs without regard to matching pairs or combinations. In any event, after the players have attached the straps 12 onto their wrists and ankles, the chance device 14 is turned upside down and shaken vigorously to mix up the balls 22-1, 22-2, etc. and then is placed in a right side up position as shown in FIG. 1 on the floor or a table. The balls pass from the enlarged upper end 20 of the glass, downwardly one at a time into the hollow stem 18 to form an ordered vertical stack of balls as shown. After or during this process, both teams of players may take the flexible elongated cords 10 and as rapidly as possible attempt to pass the cord through the color coded looped straps on their wrists and arms in the precise order as indicated by the vertical column of colored balls formed in the hollow stem. The first team to first complete the passage of the cord through all of the looped straps 12-1, 12-2 etc. on all of the players on the team wins the game.

As indicated, the flexible cord 10 is just long enough to permit its being passed or threaded through the looped straps 12-1, 12-2, etc. and different lengths of cord may be provided for different numbers of players on a team. The cords are short enough so that the players must actively manipulate their bodies and limbs in close contact with each other and this requires physical skill and coordination and adds to the fun of the game.

Referring now to FIGS. 3 and 4, the straps 12-1, 12-2, etc. are preferably formed of molded plastic material and each includes an elongated flexible body portion 26 having a pointed outer end 28 and a buckle portion 30 at the opposite end having a slotted opening 32 for receiving the pointed end 28 of the strap when it is looped around the wrist or ankle as shown in FIGS. 1 and 4. The strap body is formed with a plurality of spaced apart, specially shaped, protuberances 34 for a portion adjacent the pointed outer end 28 and these protuberances provide a means for resiliently and somewhat firmly holding the straps in a looped condition after they are placed around the wrists and ankles of the players. As illustrated in FIG. 4, the protuberances, as typified by numbers 34-1 and 34-2 are spaced apart by a distance substantially equal to the thickness of the buckle portion 30 and are disposed on opposite sides thereof when the strap is formed into a looped condition. This arrangement ensures that the looped straps do not inadvertently become loose after they have been placed around the wrists and arms of the players. The straps 12-1, 12-2, etc. are formed of resilient flexible material so that the slotted opening 32 on the buckle 30 will enlarge and stretch enough to accommodate the protuberances 34 as the outer end portion of the strap is passed through.

The present invention provides a physically active game for teams of players which is exciting and interesting and is especially well suited for party games and the like.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A game apparatus for opposing teams of two or more players comprising:

a plurality of adjustable flexible straps adapted to be looped around the arms and/or legs of the players of each team, an elongated flexible element for each team adapted to be passed through the looped straps of the players in a selected order; and chance means for randomly determining the order that a leading end portion of a flexible element is passed through the looped straps positioned on the players of each team; said chance means and said straps having corresponding indicia thereon whereby the random order determined by said chance means directs the order of passage of said flexible element through particular looped straps on said players.

2. The game apparatus of claim 1 wherein each player is provided with a pair of straps for his wrists and a pair of straps for his ankles.

3. The game apparatus of claim 1 including two pairs of straps for each player on a team, each pair having selected indicia thereon different from other such pairs.

4. The game apparatus of claim 3 wherein there is provided a corresponding pair of straps having identical selected indicia thereon for players on opposing teams.

5. The game apparatus of claim 4 wherein said chance means includes an element having a selected indicia thereon for each one of a pair of said straps having a selected indicia thereon different.

6. The game apparatus of claim 5 wherein said means includes an enclosure for containing a plurality of said elements and means formed by said enclosure for displaying said elements in a randomly determined order.

7. The game apparatus of claim 1 wherein each of said straps includes a leading end portion and an opposite end having deformable slot for receiving said leading end portion, passed therethrough to form a loop and a plurality of deformable protuberances formed on a body portion of said strap spaced apart from said leading end toward said opposite end, pairs of said protuberances operable to engage opposite sides of said opposite end of said strap for retaining said strap in said looped position around the arm or leg of a player.

8. The game apparatus of claim 7 wherein said straps are formed of flexible molded plastic material of selected colors, said colors providing said order indicia therefor.

9. The game apparatus of claim 8 wherein said chance means comprises a hollow transparent enclosure and plurality of colored elements therein including at least one element for each color of straps provided, said enclosure including a portion adapted to hold said elements in a visually observable randomly oriented order.

10. The game apparatus of claim 9 wherein said hollow enclosure is shaped to resemble a champagne glass with said portion comprising a hollow stem of said glass for holding said element in a vertically stacked order, said glass including an enlarged upper end closed at the top in communication with the upper end of said stem and an enlarged base for supporting said stem in upright position.

* * * * *